United States Patent [19]

Richardson et al.

[11] 4,454,918

[45] Jun. 19, 1984

[54] THERMALLY STIMULATING MECHANICALLY-LIFTED WELL PRODUCTION

[75] Inventors: Edwin A. Richardson; Richard A. Hinson, both of Houston, Tex.

[73] Assignee: Shell Oil Company, Houston, Tex.

[21] Appl. No.: 409,461

[22] Filed: Aug. 19, 1982

[51] Int. Cl.[3] ..... E21B 43/24

[52] U.S. Cl. ..... 166/303; 166/300; 166/369

[58] Field of Search ..... 166/303, 302, 300, 369, 166/371, 372

[56] References Cited

U.S. PATENT DOCUMENTS

| | | | |
|---|---|---|---|
| 3,399,623 | 9/1968 | Creed | 166/302 |
| 3,880,238 | 4/1975 | Tham et al. | 166/303 |
| 4,178,993 | 12/1979 | Richardsen et al. | 166/300 |

FOREIGN PATENT DOCUMENTS

| | | | |
|---|---|---|---|
| 603166 | 8/1960 | Canada | 166/303 |

*Primary Examiner*—Stephen J. Novosad
*Assistant Examiner*—Mark J. Del Signore

[57] ABSTRACT

A well which is producing slowly by artificial lift can be economically heated by first inflowing a nitrogen-generating solution, to form a pool of reacting liquid near the uppermost opening into the reservoir, then inflowing more solution while artificially-lifting liquid from near the lowermost opening into the reservoir at a rate substantially equalling the inflow rate.

7 Claims, 1 Drawing Figure

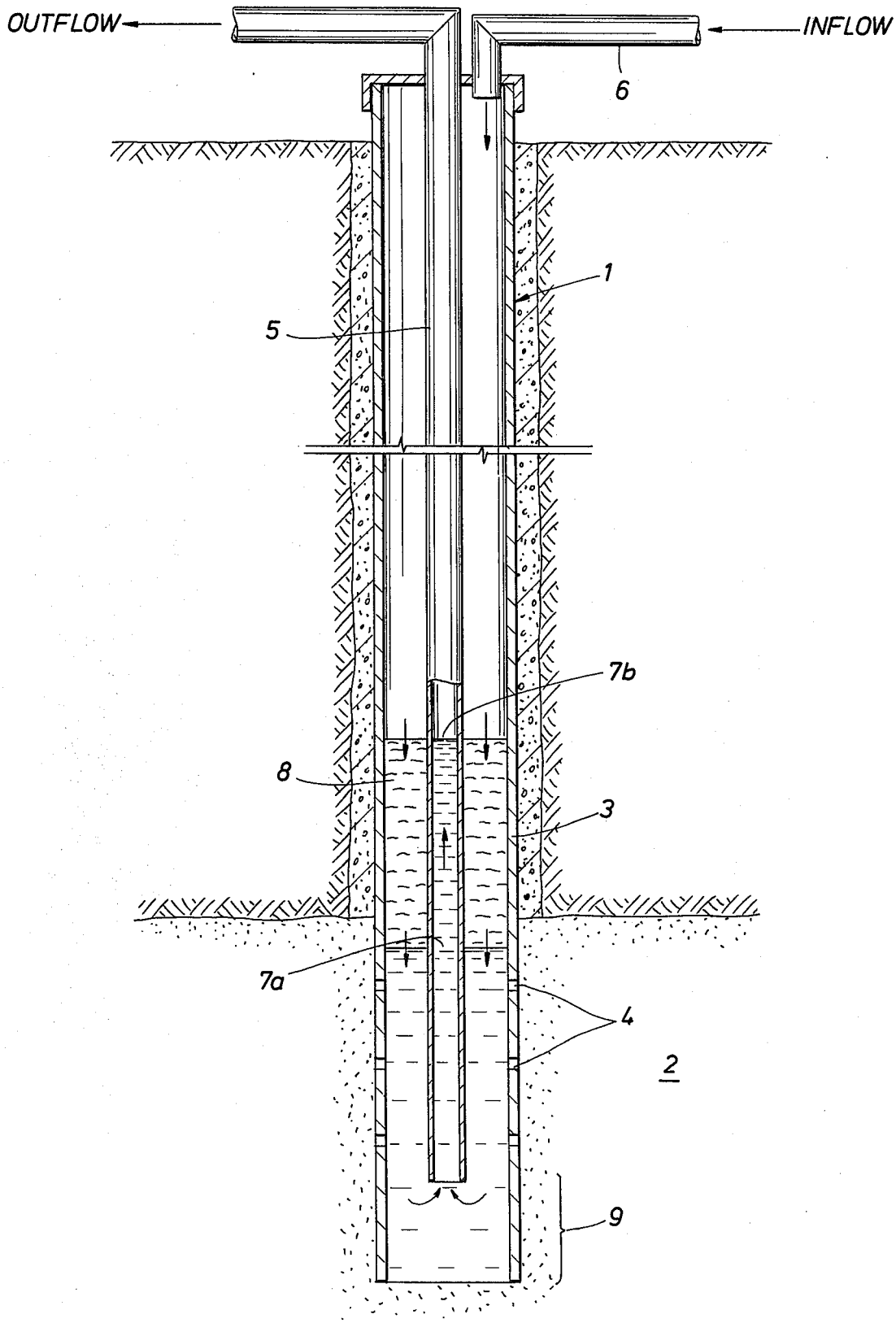
OUTFLOW
INFLOW
6
1
5
7b
8
3
7a
4
2
9

THERMALLY STIMULATING MECHANICALLY-LIFTED WELL PRODUCTION

CROSS-REFERENCE TO RELATED APPLICATION

Patent Application Ser. No. 307,035 filed Sept. 30, 1981, by E. A. Richardson and W. B. Fair, Jr. now U.S. Pat. No. 4,399,868 relates to a process for treating a well in which the openings between the borehole and reservoir are both plugged and submerged within a column of relatively dense brine. In that process, a solution of nitrogen-generating reactants is arranged to be both reactive at the reservoir temperature and denser than the brine in the well. Alternating slugs of that solution and an oil solvent are injected so that the solution sinks into and reacts within the brine and heats and displaces the solvent into contact with the plugged openings.

BACKGROUND OF THE INVENTION

The present invention relates to thermally stimulating a mechanically-lifted well by concurrently generating heat and nitrogen in or near the openings into the reservoir, while mechanically lifting liquid from the well. More particularly, the invention relates to an economical process by which such a treatment can be accomplished with relatively little equipment or down-time where the production of fluid from a well is undesirably slow in response to an artificial lifting of liquid.

Numerous procedures have been previously suggested for heating and/or dissolving plugging materials which may have been accumulated in or near the openings between the borehole of a well and the pores of a subterranean reservoir. U.S. Pat. No. 2,228,629 suggests dropping into a well borehole a silk or wool container filled with oil-coated particles of aluminum and flaked caustic soda, so that those materials will react when the fabric container is ruptured within the brine in the borehole. U.S. Pat. No. 2,799,342 suggests injecting an oil solvent dispersion of alkali metal particles (smaller than about 5 microns) into an aqueous liquid within the borehole. U.S. Pat. No. 2,889,884 suggests injecting into the reservoir a non-aqueous solvent solution of metal hydrides which are exothermically reactive with water. U.S. Pat. No. 3,279,514 suggests separately injecting fluids containing an oil solvent, water, and a liquid dispersion of a salt or hydroxide which reacts exothermically with water, so that the fluids mix and react. U.S. Pat. Nos. 3,342,264 and 3,342,265 suggest sequentially injecting compositions containing triglyceride oils (such as lecithin) an aqueous alkali, and then flushing the boreholes with water to remove such passageway plugging materials. U.S. Pat. No. 3,914,132 suggests injecting a solvent mixture of aromatic hydrocarbon and amine as an oil solvent which is capable of dissolving any contacted asphaltenic solids.

In the course of research relating to other well treating problems, it has been found that certain self-reactive aqueous solutions could be compounded and flowed into wells with their components arranged to subsequently react to yield nitrogen gas and heat at times and rates which were useful for various well treating processes. Such discoveries have been described in the following U. S. patents and patent applications.

U.S. Pat. No. 4,178,993 and its U.S. Pat. No. 30,935, by E. A. Richardson and R. F. Scheuerman describe a process for initiating fluid production from a liquid-containing well by injecting an aqueous solution containing nitrogen-gas-generating reactants having a concentration and rate of reaction correlated with the pressure and volume properties of the reservoir and the well conduits to react at a moderate rate within the well and/or the reservoir to generate enough gas to displace sufficient liquid from the well to reduce the hydrostatic pressure within the well to less than the fluid pressure within the reservoir.

U.S. Pat. No. 4,219,083 by E. A. Richardson and R. F. Scheuerman describes a process for cleaning well casing perforations by injecting an aqueous solution containing nitrogen-gas-generating reactants, an alkaline buffer providing a reaction-retarding pH and an acid-yielding reactant for subsequently overriding the buffer and lowering the pH in order to trigger a fast-rising pulse of heat and pressure which causes a perforation-cleaning backsurge of fluid through the perforations.

U.S. Pat. No. 4,232,741 by E. A. Richardson, R. F. Scheuerman, D. C. Berkshire, J. Reisberg and J. H. Lybarger describes a process for temporarily plugging thief zones within a reservoir by injecting an aqueous solution containing nitrogen-gas-generating reactants, a foaming surfactant, an alkaline buffer and an acid-yielding reactant, arranged so that they initially delay the reaction and subsequently initiate a moderate rate of gas production, in order to form a foam which is, temporarily, relatively immobile within the reservoir formation.

Patent application Ser. No. 200,176 filed Oct. 24, 1980, by D. R. Davies and E. A. Richardson now U.S. Pat. No. 4,410,041 describes a process for conducting a production test by circulating a solution of nitrogen-gas-generating reactants within conduits within a well, with the solution buffered at a pH providing a promptly-initiated reaction having a relatively mild rate and being inflowed through a well conduit at a rate such that the gas being generated serves as a lift-gas for gas-lifting fluid from the reservoir through another well conduit.

U.S. Pat. No. 4,330,037, by E. A. Richardson and W. B. Fair, Jr. describes a process for treating an oil-containing reservoir in order to concurrently chemically heat the reservoir and increase its effective permeability to oil by injecting an aqueous solution of nitrogen gas-generating reactants which is arranged to have a volume, a rate of reaction and a heat-generating capability such that the heat-generation will occur below a selected depth and will cause a selected volume of the reservoir to be heated to a selected temperature.

The disclosures of the U.S. Pat. Nos. 4,178,933; 4,219,083, 4,232,741 and 4,330,037, and the patent applications Ser. Nos. 215,895 and 307,035 are incorporated herein by cross-reference.

Many things may cause a liquid-productive well to become less productive than desired. If the production rate is not sufficiently improved by artificially lifting enough liquid from the well borehole to provide a drawdown (or inflow pressure gradient from the reservoir to the borehole) which is substantially as high as can be provided by the reservoir pressure, or can be withstood by the materials in and around the borehole of the well, a relatively expensive remedial treatment may be needed. But, usually the well operator has little or no assurance that such a remedial treatment will significantly increase the productivity of the well. A primary object of the present invention is to provide a relatively inexpensive well treating process for determining whether the productivity of a poorly productive well (which may have been standing idle because of its low productivity) can be increased by a generation of heat and nitrogen gas, or a treatment with both the so-generated heat and gas and an oil-solvent or other fluid, in and around the openings into the reservoir.

SUMMARY OF THE INVENTION

The present invention relates to treating substantially any well from which the rate of fluid production is undesirably slow in response to an artificial lifting of liquid. Conduits are arranged within the well for separately conveying inflowing fluid to a depth near the uppermost opening into the reservoir and outflowing fluid from a depth near the lowermost opening into the reservoir. Liquid is artificially lifted out of the well to the extent required to position the top of a substantially static column of liquid at a depth at least substantially as low as the uppermost opening into the reservoir. A self-reacting, aqueous liquid, heating solution containing nitrogen-generating reactants for yielding heat and gas at a significant but moderate rate at the reservoir temperature, is inflowed into the well. The initial portion of the heating solution is inflowed at a rate such that a substantially static column of liquid consisting essentially of unspent heating solution is formed within the portion of the borehole extending from substantially the lowermost to substantially the uppermost opening into the reservoir. The unspent heating solution in that column is allowed to at least begin generating a significant amount of heat and gas. Additional portions of the heating solution are then flowed into the well and into a location near the uppermost opening into the reservoir while liquid is artificially lifted out of the well from a location near the lowermost opening into the reservoir, with the rate of inflow substantially equalling the rate of outflow, so that reacting heating solution is flowed along substantially all of the openings into the reservoir.

DESCRIPTION OF THE DRAWING

The drawing is a schematic illustration of a subterranean reservoir and a well of a type in which the process of the present invention can be employed.

DESCRIPTION OF THE INVENTION

The present invention is at least in part based on a discovery that a well which is undesirably slowly productive in response to a mechanical lifting of liquid can be thermally stimulated with a relatively minimum of equipment or time. This is accomplished by forming a pool of reacting heating solution near the openings into the reservoir and circulating that liquid along those openings and adding more of the solution to the top of the pool while mechanically lifting out liquid from the bottom of the pool.

In conducting the present process, liquid can be artificially lifted from the well by substantially any type of mechanical lifting equipment, such as wireline or tubing operated swabs, sucker rod or beam pumping systems, downhole electric or downhole hydraulic jet pumps, or the like, which is capable of providing a continuous or intermittent removal of liquid. In contrast to most previously disclosed procedures for applying hot fluids to the productive interval in a well, or forming them in or near that interval; the present invention can be applied to a cased and perforated well, or a well having an open hole completion, without the need for any packer for closing the annulus around a conduit, such as a pipe string, which extends into that productive interval. The forming of a pool of reacting liquid along the productive interval and outflowing liquid at about the same rate that additional reactive liquid is added makes it feasible to generate a relatively wide range of temperatures and, if desired, continuing to do so for a significant period, while confining substantially all of the heating and treating to the productive interval.

The drawing shows a well 1 extending into a reservoir formation 2. The well is lined with a casing 3 through which perforations 4 provide openings into the reservoir. The well is equipped with an outflow conduit 5 which extends to at least about the depth of the lowermost opening into the reservoir. The well casing could be terminated above the reservoir interval to provide an open-hole completion so that the uppermost and lowermost openings into the reservoir are simply the upper and lower ends of the portion of open hole which is adjacent to the reservoir. Conduit 6, which opens into the annulus between the conduit 5 and casing 3, provides a conduit for conveying inflowing fluid to a depth near the uppermost opening into the reservoir, while conduit 5 provides a separate conduit for outflowing fluid from a depth near the lowermost opening into the reservoir.

At the stage shown in the drawing, liquid has been artificially lifted out of the well (by means not shown) to an extent positioning the top of a substantially static column of liquid 7 near the uppermost opening into the reservoir. A thermal stimulation in accordance with the present invention has been initiated by inflowing an aqueous liquid solution of nitrogen-generating reactants (arranged to yield heat and gas at a significant but moderate rate at the reservoir temperature) substantially as rapidly as feasible, to form a pool or layer of unspent heating solution 8 above the column of liquid 7 in the borehole. Even if the openings 4 into the reservoir are completely plugged, such an addition to the hydrostatic head will cause the liquid in the borehole to move, as indicated by the arrows, so that the level of the liquid in conduit 5 rises from the level shown by dotted line *7a* within conduit 5 to a higher level, shown by the dotted line *7b*, while unspent reactant 8 flows down into the vicinity of the openings into the reservoir. The downflow of the reactant solution 8 can be, if desired, enhanced by a continuous or intermittent artificial lifting of liquid out of the borehole through conduit 5.

After allowing time for the unspent heating solution to at least begin reacting in the vicinity of the openings into the reservoir, additional portions of the heating solution are inflowed through conduit 6 while liquid is being artificially lifted out of the well through conduit 5. Either or both of those inflows and outflows can be either continuous or intermittent and simultaneous or sequential as long as they are arranged to accomplish a significant flowing of additional portions of the unspent heating solution into the vicinity of the openings into the reservoir, so that at least a significant amount of heat and gas is generated in that location.

Such a concurrent inflowing of unspent heating solution and lifting-out of liquid is preferably continued for at least about several hours, in order to be sure of providing a treatment likely to remove any localized plugging in or around the openings into the reservoir. If, for example, the liquid is being removed by a beam pumping system and the treatment unplugs the openings into the reservoir to an extent creating a tendency for reservoir fluid to flow into the well, the increase in bottomhole pressure and availability of liquid to be lifted by the pumping system will be reflected by an easing of the power load on that system and/or an increase in the volume of liquid produced. If, for example, the lifting means is merely a swabbing tool which is intermittently operated within conduit 5, a tendency of reservoir fluid to flow into the borehole will be reflected by a heightened column of liquid within conduit 5 and a removal of a greater volume of liquid on the next lifting cycle of the swab.

If the well contains a significant extent of rathole portion 9 of borehole extending below the lowermost opening into the reservoir, the pool or layer of unreacted heating solution which is initially inflowed into the well, can be positioned along the openings into the reservoir above the rathole portion of the borehole by spotting a relatively high density liquid, such as a highly saline brine, within the rathole portion, so that the relatively less dense heating solution floats on top of the high density liquid. Alternatively, if a situation such as a combination of: the volume within the annular space around an internal conduit (e.g. conduit 5) extending to near the lowermost opening into the reservoir, the length of the interval of borehole which is open to the reservoir, the effective bottomhole pressure of the fluid in the reservoir, etc., results in a rather long column of fluid in the annular space (so that some portions of the openings into the reservoir may not be contacted by an initially inflowed layer of unreacted heating solution which floats on top of the liquid in the borehole) the density of the heating solution can be adjusted to exceed the density of the liquid in the borehole so the heating solution will sink into the standing liquid, as described in the cross-referenced application Ser. No. 307,035. Where desirable, portions of an oil solvent can be injected simultaneously or sequentially during the injection of unspent heating solution. Also, if desired, the borehole annulus (such as that between the casing 3 and conduit 5) can be left open to the atmosphere so that the temperature generated within the well is kept below about the boiling point of a saline aqueous solution at atmospheric pressure. Alternatively, such an annular space can be closed so that the gas which is generated in the vicinity of the openings into the reservoir increases the pressure within the borehole and tends to displace heating and/or solvent fluids into the reservoir and/or to displace liquid upward within an internal conduit (such as conduit 5). Such gas displacement procedures are described in greater detail in cross-referenced prior applications and patents. Such a pressurization of the well by gas generated within the well can be released in a manner tending to gas-lift liquid from the well and provide a drawdown pressure gradient which is substantially as high as that permitted by the reservoir fluid pressure.

SUITABLE COMPOSITIONS AND PROCEDURES

Suitable nitrogen-containing gas-forming reactants for use in the present process can comprise water-soluble amino nitrogen-containing compounds which contain at least one nitrogen atom to which at least one hydrogen atom is attached and are capable of reacting with an oxidizing agent to yield nitrogen gas within an aqueous medium. Such water-soluble nitrogen-containing compounds can include ammonium salts of organic or inorganic acids, amines, and/or nitrogen-linked hydrocarbon-radical substituted homologs of such compounds as long as they react with an oxidizing agent to produce nitrogen gas and byproducts which are liquid or dissolve in water to form liquids which are substantially inert relative to the well conduits and reservoir formations. Examples of such nitrogen-containing compounds include ammonium chloride, ammonium nitrate, ammonium nitrite, ammonium acetate, ammonium formate, ethylene diamine, formamide, acetamide, urea, benzyl urea, butyl urea, hydrazine, phenylhydrazine, phenylhydrazine hydrochloride, and the like. Such ammonium salts, e.g., ammonium chloride, ammonium formate or ammonium nitrate are particularly suitable.

Oxidizing agents suitable for use in the present process can comprise substantially any water-soluble oxidizing agents capable of reacting with a water-soluble nitrogen-containing compound of the type described above to produce nitrogen gas and the indicated types of by-products. Examples of such oxidizing agents include alkali metal hypochlorites (which can, of course, be formed by injecting chlorine gas into a stream of alkaline liquid being injected into the well), alkali metal or ammonium salts of nitrous acid such as sodium or potassium or ammonium nitrite, and the like. The alkali metal or ammonium nitrites are particularly suitable for use with nitrogen-containing compounds such as the ammonium salts. Since the reaction can occur between ammonium ions and nitrite ions, ammonium nitrite is uniquely capable of providing both the nitrogen-containing and oxidizing reactants in a single compound that is very soluble in water.

Aqueous liquids suitable for use in the present invention can comprise substantially any in which the salt content does not (e.g. by a common ion effect) prevent the dissolving of the desired proportions of N-containing and oxidizing reactants. In general, any relatively soft fresh water or brine can be used. Such aqueous liquid solutions preferably have a dissolved salt content of less than about 1000 ppm monovalent salts and less than about 100 ppm multivalent salts.

Alkaline buffer compounds or systems suitable for initially retarding the rate of gas generation can comprise substantially any water-soluble buffer which is compatible with the gas-forming components and their products and tends to maintain the pH of an aqueous solution at a value of at least about 7. Examples of suitable buffering materials include the alkali metal and ammonium salts of acids such as carbonic, formic, acetic, citric, and the like, acids. For relatively high pHs such as 8 or more (e.g. for use at higher temperatures) the weak acid portions of such systems can include the salts of amines or amino-substituted compounds such as ethylenediamemetetraacetic acid (EDTA), triethanolamine (TEA), glycine (aminoethanoic acid), aniline, and the like.

In some situations it may be desirable to use relatively concentrated and fast-reacting nitrogen-generating components such as at least about 3 moles per liter of each of ammonium nitrate and sodium nitrite. The advantages of such a relatively high density solution in sinking below the liquid in a borehole are described in greater detail in the cross-referenced application Ser. No. 307,035. Such relatively concentrated solutions often contain enough dissolved solids to provide an aqueous solution density exceeding that of the reservoir brine. However, if for example, it is desirable to use a relatively high density solution containing less concentrated reactants in order to limit the amount of heat to be generated or to delay the onset of heat generation to avoid heating above a particular depth in the well, or the like, relatively inert solids, such as alkali metal or alkaline earth metal salts of strong acids, can be added to provide a selected relatively high solution density with the smaller proportion of reactants. Particularly suitable salts for such a use are the sodium and potassium chlorides.

The oil solvents, which can be used if desired, can comprise substantially any liquid organic compounds which are solvents for paraffinic and/or asphaltenic oils or petroleum type compounds which are likely to be plugging deposits to be removed. Aromatic solvents such as benzene, xylene and the like and/or diesel oil or the like hydrocarbon fractions containing aromatic hydrocarbons are particularly suitable solvents.

As will be apparent to those skilled in the art, the concentrations at which the individual amino nitrogen-containing and oxidizing agent-containing solutions can be combined to form the nitrogen-gas-generating solution, can be varied to suit the solubility properties of the compounds containing those ions and the proportions in which such solutions are to be combined. For example, if the nitrogen-containing compound is the least soluble compound, it can be dissolved at a molarity less than twice the molarity selected for the treating solution and then mixed, in a greater than equal proportion, with a smaller than equal proportion of a more concentrated solution of the more soluble compound, in order to combine the reactants in stoichiometric proportion. Of course, in various situations, a less than stoichiometric molecular proportion of the less soluble reactant can be combined with an excess of the more soluble reactant.

HYPOTHETICAL WELL TREATMENT

A candidate well for treatment with the present process may have the following features. The well is open into a reservoir at depths between 4467 and 4538 feet. The amount of liquid produced from the well with the beam pumping system for lifting liquid is less than about 0.1 barrels per minute or 144 barrels per day. The annular space around the tubing contains 0.0158 barrels per foot. Thus, the volume of liquid above the perforations and pump amounts to about 1.91 barrels.

In initiating a treatment by the present process, about 2 barrels of a nitrogen-generating heating solution is arranged to release its heat within about 10 minutes at the reservoir temperature (about 100° F.). Such a solution can consist essentially of 3 M/L $NaNO_2$ and 3 M/L $NH_4NO_3$. The solution is poured or pumped into the casing substantially as fast as possible. The rate of inflowing the heating fluid is then slowed to the about 0.1 barrel per minute rate, i.e., about the rate at which liquid is being lifted out of the well. This provides a pool of reacting liquid which is flowing along and generating heat and gas substantially all along the openings into the reservoir, from a depth of about 10 to 50 feet above the uppermost perforation to that of the intake of the pump. That treatment is continued for about 180 minutes, so that a total of about 20 barrels of heating solution is inflowed into the well. The casing can be left open to vent the gas which is generated.

During such a treatment, the height of the column of liquid within the well will remain relatively steady, unless the formation opens up so that fluid starts to flow into the well at a fast rate. For a well producing about 0.007 to 0.014 barrels per minute (10 to 20 barrels per day) the liquid column height would not be significantly changed. For a well producing 0.1 barrel per minute, the fluid level would rise until the drawdown becomes zero. In the candidate well such a rate of rise (at an inflow of 0.1 Bpm) would be about 6 feet per minute, or 1,139 feet during the treatment; unless the rate of pumping-out the liquid were to be increased, or the outflow of gas from the casing were to be restricted, so that the bottomhole pressure was increased to an extent to which the inflow rate decreased.

Following such a treatment, it may be advantageous to add 1 or 2 barrels of an oil solvent liquid such as xylene, e.g., with the solvent being inflowed relatively fast at the end of the treatment to clean wax out of the upper portions of the tubing string. In addition, it may be desirable to wash the casing free of any treating fluid in order to avoid the possibility of corrosion due to any remaining concentration cells of partially spent treatment solution. Such a washing can be accomplished by simply dumping several barrels of brine into the casing and allowing it to be subsequently produced.

In general, the determinations of the currently existing properties such as the temperature or volume or injectivity of the well and reservoir to be treated can be conducted or ascertained by logging or measuring procedures such as those currently available and/or by previous experience in the same or an adjacent well. The temperatures provided by the present heating procedure at a particular downhole location can be monitored during the treatment by means of conventional tools and, at least to some extent, such temperatures can be varied by varying the rate at which the nitrogen-gas-generating solution is injected, e.g., by varying the amount of concurrently injected relatively inert liquid such as an oil-solvent.

What is claimed is:

1. A process for treating a liquid-productive well from which the rate of fluid production is undesirably low in response to an artificial lifting of liquid from the well which comprises:

arranging separate conduits in the well for conveying inflowing fluid to a location at least near the uppermost opening into the reservoir and conveying outflowing fluid from a location at least near the lowermost opening into the reservoir;

artificially lifting liquid from the well to the extent required to position the top of a substantially static column of liquid at a location at least near the uppermost opening into the reservoir;

inflowing into the well a self-reactive heating solution consisting essentially of an aqueous liquid solution of nitrogen-generating reactants for generating heat and gas at a significant but moderate rate at a temperature at least as high as the reservoir temperature;

initially inflowing the heating solution at a relatively fast rate such that a static column of liquid consisting essentially of unspent heating solution is formed in a location at least near the uppermost opening into the reservoir;

allowing the heating solution in said column of heating solution to at least begin generating a significant amount of heat; and artificially lifting liquid from the well from a location at least near the lowermost opening into the reservoir while inflowing unspent heating solution into a location at least near the uppermost opening into the reservoir with the rates of the flow into and out of the well arranged so that portions of heat-generating heating solution are flowed along substantially all of the openings into the reservoir, so that an increase in the rate of liquid production from the well may indicate that that can be obtained by such treatment of the well.

2. The process of claim 1 in which the inflowing of heating fluid is accompanied by an inflowing of liquid oil solvent.

3. The process of claim 1 in which a portion of liquid having a density exceeding that of the heating solution is deposited in a portion of the well extending below the lowermost opening into the reservoir.

4. The process of claim 1 in which the heating solution which is inflowed has a density exceeding that of the liquid in the borehole.

5. The process of claim 1 in which a wireline-actuated pumping or swabbing device is used to artificially lift liquid from the well.

6. The process of claim 1 in which a beam pumping system for artificially lifting liquid from the well is operated substantially throughout the inflowing of the heating solution.

7. The process of claim 1 in which the well contains an annular conduit around a conduit for conveying outflowing fluid from a location near the lowermost opening into the reservoir and said annular conduit is open from the reservoir to the surface.

* * * * *